US007649433B2

(12) United States Patent
Eley et al.

(10) Patent No.: US 7,649,433 B2
(45) Date of Patent: Jan. 19, 2010

(54) CIRCUIT BREAKER WITH MAGNETICALLY-COUPLED TRIP INDICATOR

(75) Inventors: Edgar R. Eley, Jackson, TN (US); John B. Baskin, Jackson, TN (US); Fabian D. Stacy, Jackson, TN (US)

(73) Assignee: ABB Technology AG, Zurich (CH)

( * ) Notice: Subject to any disclaimer, the term of this patent is extended or adjusted under 35 U.S.C. 154(b) by 119 days.

(21) Appl. No.: 11/633,676

(22) Filed: Dec. 4, 2006

(65) Prior Publication Data

US 2008/0127882 A1 Jun. 5, 2008

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 73/12*** | (2006.01) |
| ***H01H 35/40*** | (2006.01) |
| ***H01H 9/00*** | (2006.01) |

(52) U.S. Cl. ..... 335/17; 200/308; 200/81.9 M

(58) Field of Classification Search ..... 335/17; 116/204, 267; 200/81.9 M, 308; 218/91–116
See application file for complete search history.

(56) References Cited

U.S. PATENT DOCUMENTS

| | | | | | |
|---|---|---|---|---|---|
| 1,834,550 | A | * | 12/1931 | Reed | 335/17 |
| 1,980,471 | A | * | 11/1934 | Burnham | 218/103 |
| 2,385,008 | A | * | 9/1945 | Baker et al. | 218/107 |
| 2,420,888 | A | * | 5/1947 | Leeds | 218/107 |
| 2,448,695 | A | * | 9/1948 | Van Ryan | 335/17 |

(Continued)

*Primary Examiner*—Elvin G Enad
*Assistant Examiner*—Alexander Talpalatskiy
(74) *Attorney, Agent, or Firm*—Paul R. Katterle; John L. Lee; Lee Patent Services

(57) ABSTRACT

An oil-immersed circuit breaker is provided having a mechanical/magnetic trip indicator. In a preferred embodiment, the trip indicator comprises a mechanical drive train (coupled to a conventional trip-sensing mechanism), a push piece, and an indicator piece. The drive train and the push piece are located inside the enclosure immersed in oil. The indicator piece is located outside the enclosure. The push piece is magnetically coupled to the indicator piece. Magnetic coupling eliminates problems encountered with prior art trip indicators associated with oil-seal leakage, electrical component failure, and power source failure.

6 Claims, 4 Drawing Sheets

U.S. PATENT DOCUMENTS 2,490,987 A * 12/1949 Van Ryan ..... 335/240
2,574,801 A * 11/1951 Thompson et al. ..... 335/18
2,693,515 A * 11/1954 Hodnette et al. ..... 337/78
2,695,401 A * 11/1954 Broverman ..... 335/17
3,258,968 A * 7/1966 Woodcock ..... 73/308
3,364,897 A * 1/1968 Mouwen ..... 165/80.3
3,368,405 A * 2/1968 Christian ..... 73/306
3,611,220 A * 10/1971 Hoffman ..... 335/207
3,626,474 A * 12/1971 Hammer ..... 137/554
3,815,542 A * 6/1974 Cooper ..... 116/221
3,860,898 A * 1/1975 Leonard ..... 337/59
3,983,454 A * 9/1976 Cotton et al. ..... 361/37
4,336,520 A * 6/1982 Trayer ..... 337/191
4,489,299 A * 12/1984 Wien et al. ..... 337/70
4,611,189 A * 9/1986 Mikulecky ..... 335/37
4,617,545 A * 10/1986 Link ..... 337/74
4,999,615 A * 3/1991 Toupin et al. ..... 340/590
5,049,013 A * 9/1991 Engles et al. ..... 409/231
5,237,957 A * 8/1993 Liucci ..... 116/267
5,933,063 A * 8/1999 Keung et al. ..... 335/18
6,069,544 A * 5/2000 Seymour et al. ..... 335/185
6,572,523 B2 * 6/2003 Herman et al. ..... 494/10
6,828,886 B2 * 12/2004 Germain et al. ..... 335/18
7,154,061 B2 * 12/2006 Eley et al. ..... 218/154
2006/0017531 A1 * 1/2006 Eley et al. ..... 335/16

* cited by examiner

CIRCUIT BREAKER WITH MAGNETICALLY-COUPLED TRIP INDICATOR

TECHNICAL FIELD

This invention relates generally to high-voltage, oil-immersed circuit breakers used in AC power distribution switching systems. More specifically the invention relates to the design of external trip indicators incorporated in such circuit breakers.

BACKGROUND

An external trip indicator for an oil-immersed circuit breaker requires transmission of the open/closed state of the breaker contacts through the wall of the oil-filled housing that encloses the breaker contacts.

Mechanical trip indicators are generally preferred for use in circuit breakers because a simple mechanical coupling provides a more direct and reliable indication of the state of the breaker contacts. However, prior art mechanical trip indicators with external display used in oil-immersed circuit breakers require an oil-seal around the mechanical component that passes through the wall of the oil-filled housing, and such oil-seals are prone to leak.

Electrical trip indicators avoid the problems associated with leak-prone oil-seals. However, prior art electrical trip indicators are subject to the risk of electrical component failure and power source failure.

SUMMARY OF INVENTION

The present invention provides a circuit breaker with oil-immersed moving contacts and a mechanical/magnetic trip indicator. In a preferred embodiment, the trip indicator comprises a mechanical drive train (coupled to a conventional trip-sensing mechanism), a push piece, and an indicator piece. The drive train and the push piece are located inside the enclosure. The indicator piece is located outside the enclosure. The push piece is magnetically coupled to the indicator piece. Magnetic coupling eliminates problems encountered with prior art trip indicators associated with oil-seal leakage, electrical component failure, and power source failure.

In the preferred embodiment, the circuit breaker includes a housing having a wall, an indicator piece, and a magnetic coupler for transmitting movement of the contacts through the wall by repulsive magnetic force to cause a flag end to protrude from an outer face of the wall. The wall defines an inner face and an outer face, the inner face defining an enclosure shaped to contain the moving contacts and the oil. The indicator piece includes a magnetic end and a flag end. The indicator piece is mounted for movement within an outer cavity in the outer face of the wall.

In the first preferred embodiment, the magnetic coupler includes a push piece with a magnetic end. The push piece is mounted for movement within an inner cavity in the inner face of the wall. The push piece is mechanically coupled to the contacts, and is magnetically coupled to the indicator piece.

In the first preferred embodiment, the push piece and the indicator piece are axially aligned cylindrical rods adapted to slide in axially aligned cylindrical cavities.

In the first preferred embodiment, the flag is a cylindrical flag, and the outer face of the wall defines at least one cylindrical wall portion surrounding and concentric with the indicator piece, such that the cylindrical flag, while protruding from an outer end portion of a cylindrical portion of wall outer face, is easily visible from many angles of view.

In the first preferred embodiment, the indicator piece is magnetically coupled to the push piece via a non-magnetic section of the wall.

In the first preferred embodiment, the indicator piece is spring-loaded by a spring, preferably a coiled spring, for retention within the outer cavity.

In the first preferred embodiment, the circuit breaker includes moving contacts immersed in oil, a housing having a wall, a push piece with a magnetic end and a cam follower end, and an indicator piece with a magnetic end and a flag end. The wall defines an enclosure shaped to contain the moving contacts and the oil, an inner cavity as part of the enclosure, and an outer cavity, proximate to the inner cavity, on the opposite side of the wall to the outer cavity. The push piece is mounted for movement within the inner cavity, and is mechanically coupled to the moving contacts. The indicator piece is mounted for movement within the outer cavity, and is coupled by repulsive magnetic force to the push piece. Movement of the contacts causes the flag end to protrude from the outer cavity.

In the first preferred embodiment, the circuit breaker includes a moving contacts assembly, and a pivoted contact bar having a cam end. The moving contacts assembly is mechanically coupled to pivot the contact bar. The contact bar cam end is mechanically coupled to drive the push piece via the cam follower end of the push piece.

The preferred method for displaying trip status of a circuit breaker having an enclosure containing oil-immersed contacts, according to the present invention, includes: using mechanical energy from a moving contacts assembly to move a first magnet located inside the enclosure, and using repulsive magnetic force from the first magnet to move a second magnet located outside the enclosure, such that a flag end attached to the second magnet is displayed outside the enclosure.

DETAILED DESCRIPTION

The present invention provides a circuit breaker with oil-immersed contacts in an enclosure and a mechanical/magnetic trip indicator. The present invention provides a circuit breaker with oil-immersed contacts in an enclosure and a mechanical/magnetic trip indicator. In a preferred embodiment, the trip indicator comprises a mechanical drive train (coupled to a conventional trip-sensing mechanism), a push piece, and an indicator piece. The drive train and the push piece are located inside the enclosure. The indicator piece is located outside the enclosure. The push piece is magnetically coupled to the indicator piece. Magnetic coupling eliminates problems encountered with prior art trip indicators associated with oil-seal leakage, electrical component failure, and power source failure.

Figure 1:
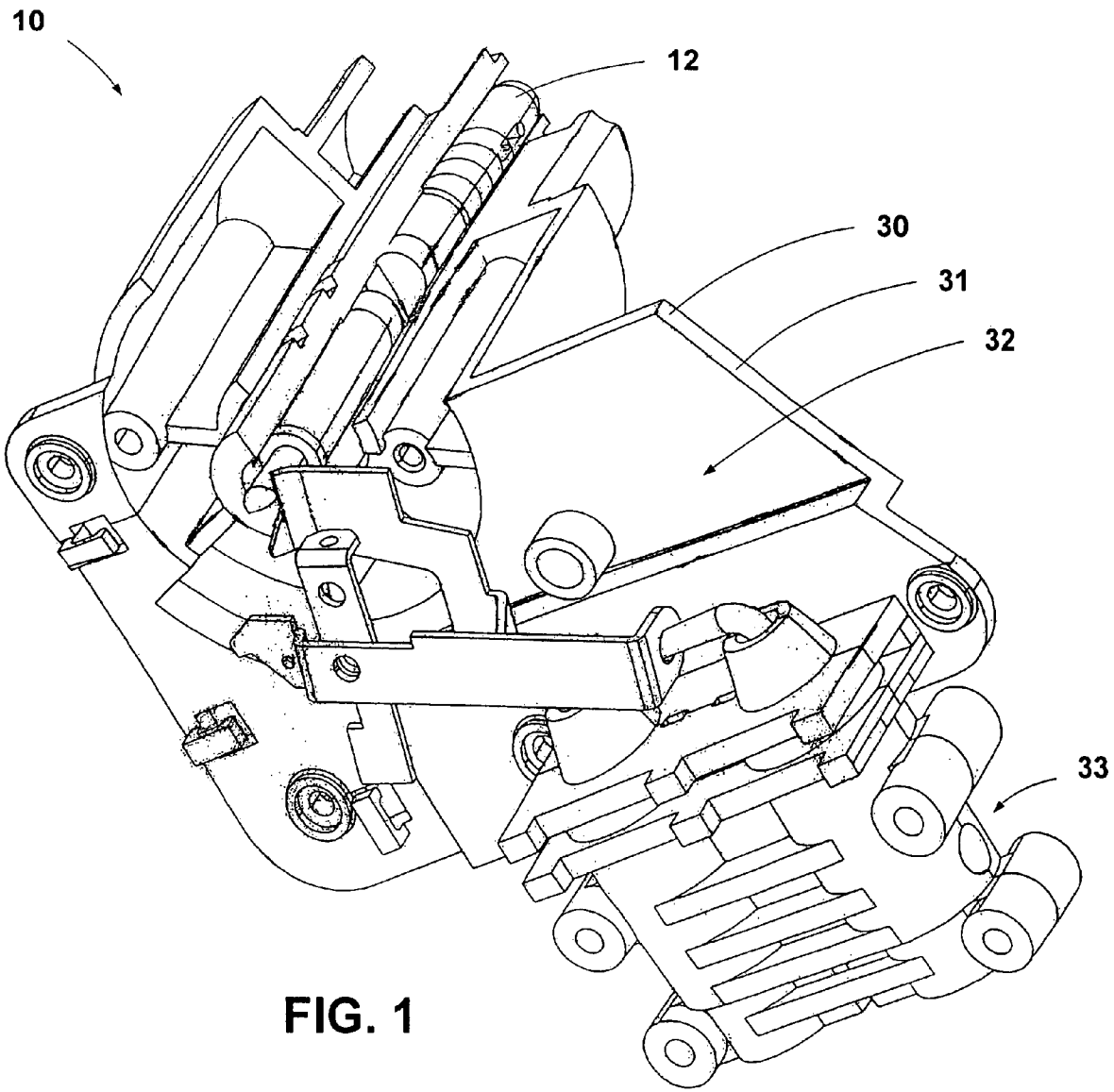
FIG. 1 is a cut-away perspective line drawing of a first preferred embodiment of the invention with the circuit breaker closed and the indicator piece retracted.

Circuit breaker 10 of the first preferred embodiment is shown in FIG. 1 with circuit breaker closed and indicator piece 12 retracted. Circuit breaker 10 is shown in FIG. 2 with circuit breaker tripped and indicator piece 12 protruding so that flag end 16, at the front end of indicator piece 12, is visible.

Figure 2:
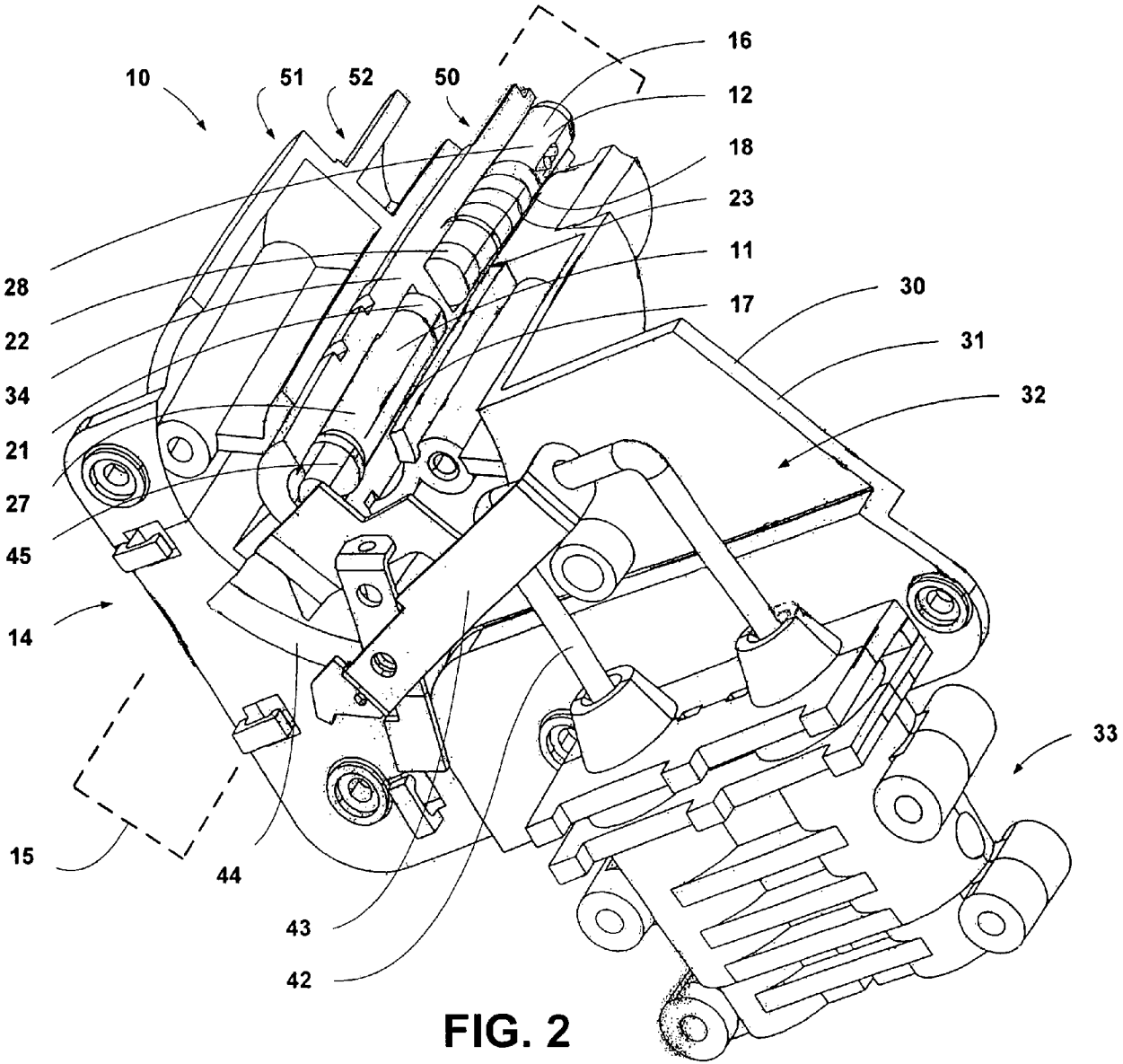
FIG. 2 is a cut-away perspective line drawing of the first preferred embodiment with the circuit breaker tripped and the flag end protruding.

As shown in each of FIGS. 1 and 2, circuit breaker 10 includes housing 30 having a wall 31. Wall 31 defines enclosure 32 which is closed to contain oil. When the circuit breaker is in use, enclosure 32 is filled with oil. Circuit breaker 10 includes contacts mechanism 33. Contacts mechanism 33 is enclosed within enclosure 32, and when the circuit breaker is in use, moving electrical contacts (not shown) within contacts mechanism 33 are also immersed in oil.

The components that constitute trip indicator 14 are shown in FIGS. 1 and 2. Referring to FIG. 2, trip indicator 14 transmits the state of the contacts (closed or open) to indicator piece 12. The moving components of trip indicator 14 are: moving contacts assembly 42, pivoted contact bar 43 with its cam end 44, push piece 11 and indicator piece 12.

Figure 3:
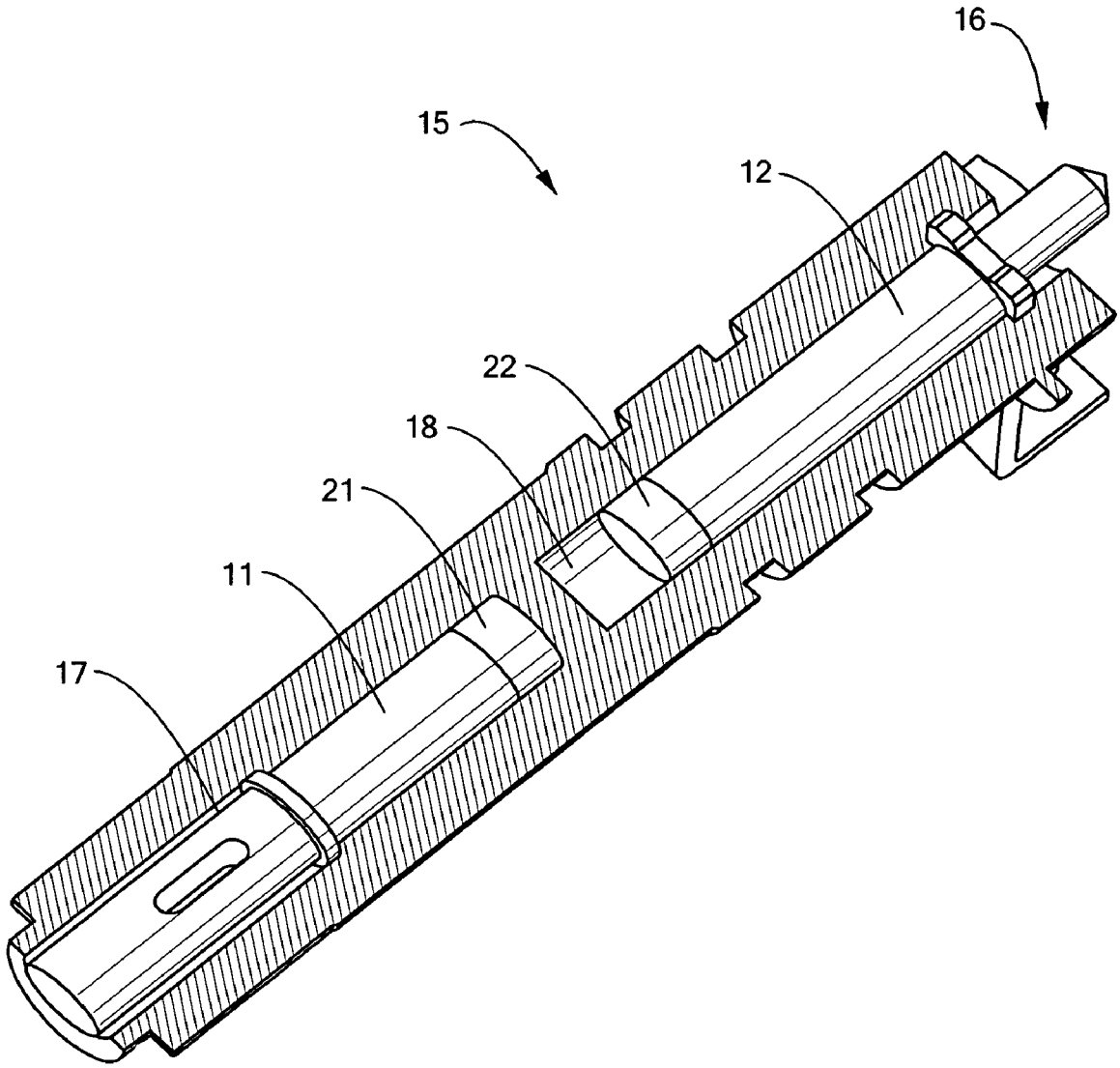
FIG. 3 is a computer-generated perspective view of the magnetic coupler of the trip indicator shown in FIGS. 1 and 2.

A key subassembly of the trip indicator is magnetic coupler 15. Magnetic coupler 15 includes two mechanical/magnetic components, push piece 11 and indicator piece 12. Each is preferably cylindrical in the form of a short rod, as shown in FIG. 3. Indicator piece 12 is shown spring-loaded by coiled spring 23. Magnetic coupler 15 is further illustrated in FIG. 3.

Push piece 11 is located in inner cavity 17 within the inner face of wall 31. Inner cavity 17 is shaped as a blind bore. Indicator piece 12 is located in outer cavity 18 within the outer face of wall 31. Outer cavity 18 is proximate to inner cavity 17 on the opposite side of wall 31. Outer cavity 18 is also shaped as a blind bore. Inner cavity 17, because it is part of enclosure 32, contains oil. Outer cavity 18, outside enclosure 32, does not contain oil. Push piece 11 includes magnet 21 attached to the front end of molded plastic shaft 27. Indicator piece 12 includes magnet 22 attached to the back end of molded plastic shaft 28. Spring-loaded indicator piece 12 is spring-loaded so as to urge indicator piece 12 back into bore 18. Push piece 11 and indicator piece 12 are magnetically coupled through wall section 34 of wall 31. The two magnets are oriented one to the other with facing ends of like polarity. Also, the two magnets face each other across non-magnetic wall section 34 of wall 31. In the preferred embodiment, wall section 34 is made of plastic or other non-ferrous material so that magnet 21 of push piece 11, as it is driven forward, tends to repel magnet 22 of indicator piece 12, and thereby urge indicator piece 12 forward.

In other embodiments, the magnetic coupler can be any assembly that uses a repulsive magnetic force to translate motion between an actuator inside an oil-filled enclosure, and an indicator outside the oil-filled enclosure.

Figure 4:
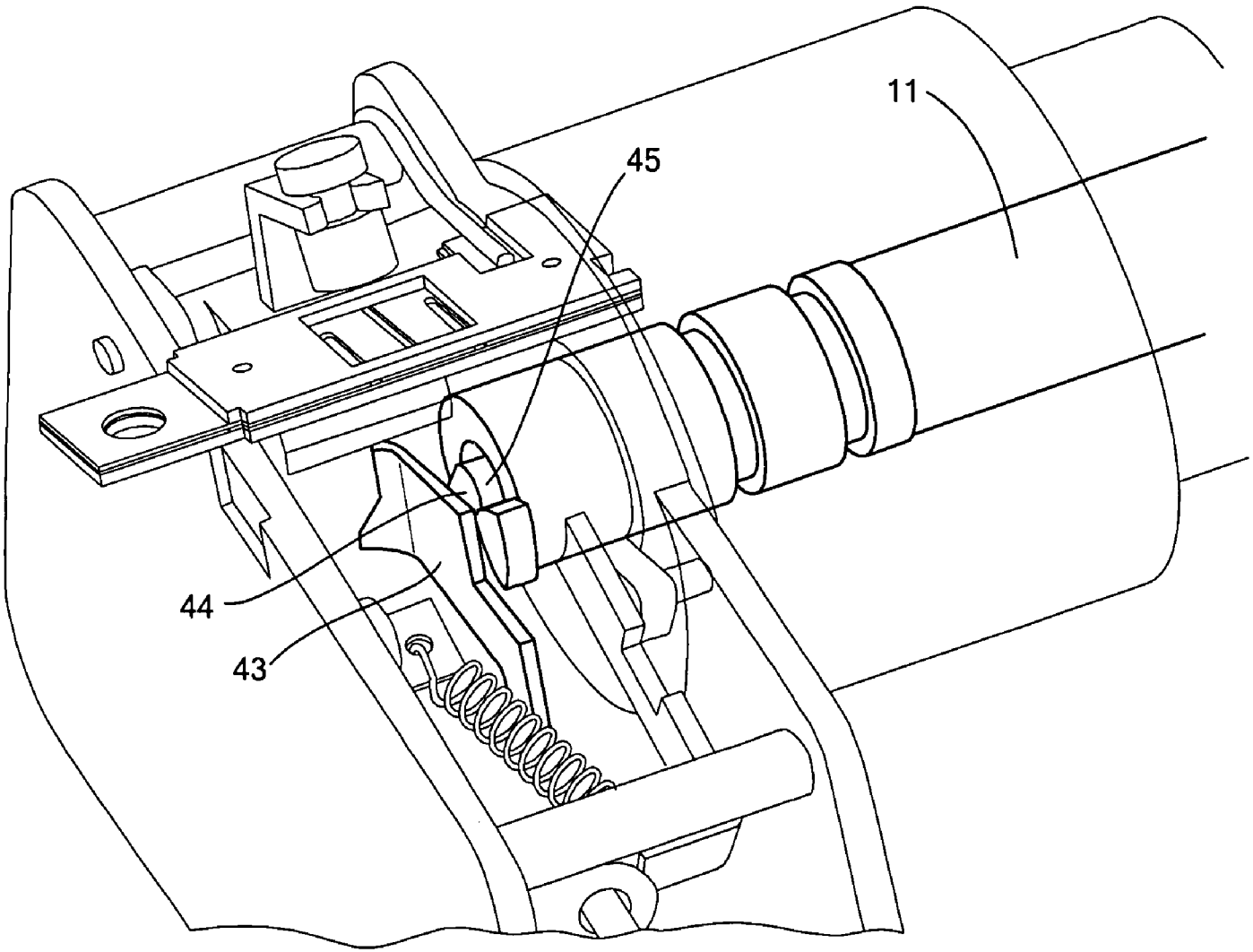
FIG. 4 is a computer-generated perspective view of the cam-action components of the trip indicator shown in FIGS. 1 and 2.

FIGS. 2 and 4 identify the linked mechanical components of a mechanical drive train. Referring to FIG. 2, this drive train includes components that transmit mechanically the position of the contacts to push piece 11. In the preferred embodiment, the drive train includes moving contacts assembly 42 (which includes moving contacts—not shown), pivoted contact bar 43, and cam end 44 of bar 43. These mechanical components are all located inside the oil-filled enclosure. They are all immersed in oil. Push piece 11 is a magnetic/mechanical component that is driven at its cam follower end 45 by the drive train, and is magnetically coupled to indicator piece 12 as part of magnetic coupler 15.

Trip indicator 14 operates as follows. When the breaker trips, the breaker contacts open. When the breaker contacts open, the front end of moving contacts assembly 42 moves outward, away from the contacts in contacts mechanism 33. This movement of assembly 42 rotates bar 43 and its associated cam end 44. The back end of push piece 11 serves as a cam follower, cam follower end 45, as shown in FIGS. 2 and 4. So push piece 11 is driven forward by cam end 44. This causes the magnets of push piece 11 and indicator piece 12 to come into in close proximity, causing push piece 11 to repel indicator piece 12, moving it forward. Indicator piece 12, by moving forward, causes flag end 16 to protrude and become visible.

When the circuit breaker next closes, spring force from coiled spring 23 causes indicator piece 12 to retract and hide flag end 16.

FIG. 2 shows the indicator end of the first preferred embodiment with the circuit breaker tripped. It also shows cylindrical flag end 16 protruding from trip indicator display end 50 of housing 30.

In the first preferred embodiment, push piece 11 and indicator piece 12 are axially aligned cylindrical rods sliding in axially aligned cylindrical cavities 17 and 18, respectively. Wall 31 of housing 30 defines cavities 17 and 18. Wall 31 also defines larger-diameter cylindrical portion 51 of wall outer face and smaller-diameter cylindrical portion 52 of wall outer face. Wall portion 52 surrounds indicator piece 12. Thus, the preferred embodiment displays indication of trip as a cylindrical flag protruding from display end 50 at a smaller-diameter cylindrical portion of wall outer face, and the smaller-diameter cylindrical portion protrudes from a larger-diameter cylindrical portion of wall outer face. So the flag easily visible from many angles of view.

What is claimed is:

1. A circuit breaker, comprising:

moving contacts immersed in oil; a cam mounted for movement upon movement of the contacts;

a housing having a wall, the wall defining an enclosure shaped to contain the moving contacts and the oil, an inner cavity as part of the enclosure, and an outer cavity, proximate to the inner cavity, on the opposite side of the wall to the outer cavity;

a push piece with a magnetic end and a cam follower end, the push piece mounted for movement within the inner cavity, the push piece mechanically coupled to the moving contacts; and an indicator piece with a magnetic end and a flag end, the indicator piece mounted for movement within the outer cavity, the indicator piece coupled by repulsive magnetic force to the push piece;

such that movement of the contacts causes the cam to engage the cam follower of the push piece and thereby move the push piece which causes the flag end of the indicator piece to protrude from the outer cavity.

2. A circuit breaker according to claim 1, wherein the push piece and the indicator piece are axially aligned cylindrical rods adapted to slide in axially aligned cylindrical cavities.

3. A circuit breaker according to claim 2, wherein the flag is a cylindrical flag, and the outer face of the wall defines at least one cylindrical wall portion surrounding and concentric with the indicator piece, such that the cylindrical flag, while protruding from an outer end portion of a cylindrical portion of wall outer face, is easily visible from many angles of view.

4. A circuit breaker according to claim 1, further comprising a spring coupled to the indicator piece, such that the indicator piece is spring-loaded by the spring for retention within the outer cavity.

5. A circuit breaker according to claim 4, wherein the spring is a coiled spring.

6. A circuit breaker according to claim 1, further comprising a moving contacts assembly, and a pivoted contact bar having a cam end, the moving contacts assembly mechanically coupled to pivot the contact bar, the contact bar cam end mechanically coupled to drive the push piece via the cam follower end.

* * * * *